US005224465A

United States Patent [19]

Milliman

[11] Patent Number: 5,224,465

[45] Date of Patent: Jul. 6, 1993

[54] AIR GUN WITH BAFFLE FOR LIMITING MAXIMUM VELOCITY

[75] Inventor: Keith L. Milliman, Fairport, N.Y.

[73] Assignee: Crosman Corporation, Bloomfield, N.Y.

[21] Appl. No.: 846,706

[22] Filed: Mar. 6, 1992

[51] Int. Cl.[5] ..... F41B 11/32; F41B 11/26

[52] U.S. Cl. ..... 124/76; 124/69; 124/73

[58] Field of Search ..... 124/45, 48, 56, 63, 124/70–74, 76, 82, 83; 137/115, 872, 881

[56] References Cited

U.S. PATENT DOCUMENTS

| | | | |
|---|---|---|---|
| 2,526,592 | 10/1950 | Tratsch | 124/73 |
| 2,594,240 | 4/1952 | Wells | 124/70 X |
| 2,635,599 | 4/1953 | Wells | 124/69 |
| 3,381,403 | 5/1968 | Murdoch | 124/73 X |
| 3,420,220 | 1/1969 | Ferrando | 124/70 X |
| 4,116,193 | 9/1978 | Chiba | 124/72 |
| 4,304,213 | 12/1981 | Jereckos | 124/69 |
| 4,422,433 | 12/1983 | Milliman | 124/74 |
| 4,616,622 | 10/1986 | Milliman | 124/73 |
| 4,774,929 | 10/1988 | Milliman | 124/76 |
| 4,967,724 | 11/1990 | Senfter | 124/76 |
| 5,078,118 | 1/1992 | Perrone | 124/74 |

*Primary Examiner*—Randolph A. Reese

*Assistant Examiner*—John Ricci

[57] ABSTRACT

An air gun includes a valve assembly with a sliding baffle for limiting the maximum velocity and energy which can be provided by the gun. The valve assembly includes a valve body which has a pressure reservoir, an air passage, and a valve seat between the pressure reservoir and the air passage. A valve normally closes the valve seat to hold pressure in the pressure reservoir and is moved away from the valve seat when the gun is fired. A bleed opening in the valve body connects the air passage to the outside of the valve body, and an exhaust opening connects the air passage to the barrel of the gun. The baffle is slidably mounted in the air passage and is movable between a first position in which the bleed opening is restricted and the exhaust opening is unobstructed and a second position is which the exhaust opening is restricted and the bleed opening is substantially unobstructed.

16 Claims, 3 Drawing Sheets

AIR GUN WITH BAFFLE FOR LIMITING MAXIMUM VELOCITY

BACKGROUND

This application relates to air guns, and, more particularly, an air gun with a spring-loaded baffle for limiting the maximum velocity or energy which can be obtained with the gun.

A multi-stroke pneumatic air gun normally operates by compressing an air charge into a valve assembly and discharging the pressurized air to propel a projectile. As the gun is pumped, each stroke increases the pressure in the valve, thereby increasing the velocity and energy of the projectile. To limit the maximum energy and velocity which is obtainable with a given gun, various devices have been used such as bleed-off holes located between the valve seat and the projectile and pressure regulators which limit the maximum pressure which is obtainable within the valve reservoir. Bleed-off holes not only reduce maximum velocity, but reduce the velocity which can be obtained with fewer compressive strokes. Bleed-off holes may also be ineffective in limiting the velocity of low mass projectiles because of the shock wave which is created by the discharge of relatively high pressure. Pressure regulators are relatively complex in nature and introduce additional leak points to the mechanism, thereby lowering reliability. Pressure regulators can also be subject to surge created by increasing the pressure in the valve by the relative speed at which the compressive means are applied.

SUMMARY OF THE INVENTION

The invention uses a spring-loaded baffle to limit the velocity and energy produced by an air gun. The baffle is cylindrical and is slidably mounted on the valve stem. A bleed-off hole is located forwardly of the valve exhaust port and is partially shrouded by the baffle.

With low pressure contained in the valve reservoir, when the valve is opened, compressed air travels between the outside of the baffle and the valve body bore to the exhaust port. The compressed air causes the baffle to slide on the valve stem against the spring, thereby partially shrouding the bleed-off hole and permitting the majority of the air charge to reach the projectile. This results in minor performance reduction at low pressure, but the reduction is minimized by the shrouding effect of the baffle on the bleed-off hole.

When medium pressure is contained in the valve reservoir, travel of the baffle is increased due to greater air pressure impacting the baffle. However, the bleed-off hole remains partially shrouded and the velocity of the projectile increases substantially the same as in a conventional gun.

At high pressure, the baffle is impacted by the air charge and forced fully rearwardly and partially shrouds the exhaust port. The bleed off hole is fully exposed and exhausts the air charge contained in the valve reservoir. The placement of the baffle in the valve bore breaks up the high pressure shock wave which would normally travel through the valve bore, thereby negating its effect. As pressure is further increased, the baffle travel time to its rearward stop is reduced and velocity decreases because of the shrouding effect of the baffle on the exhaust port.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
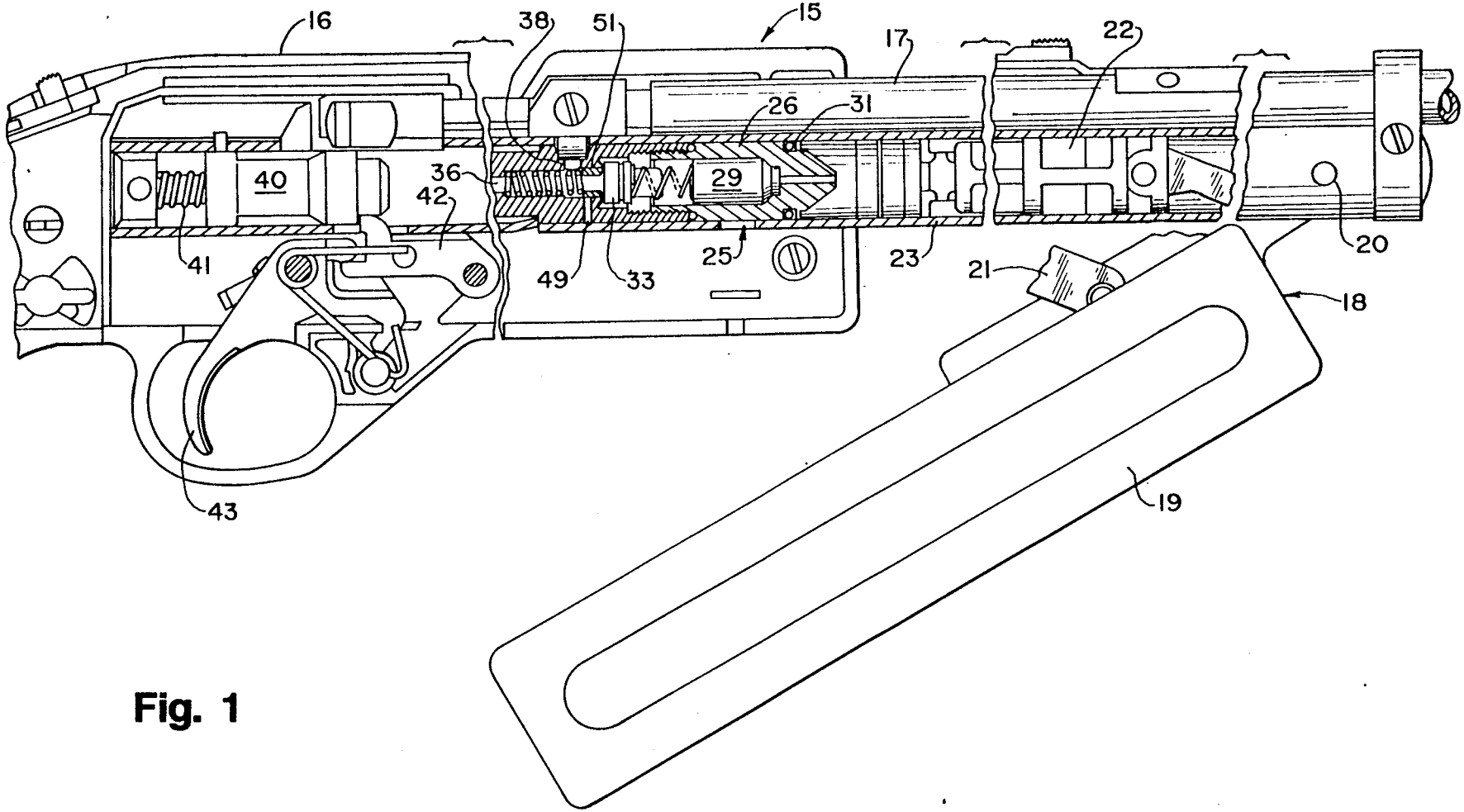
FIG. 1 is a fragmentary sectional view of an air gun which is equipped with a spring-loaded baffle in accordance with the invention.

Referring to FIG. 1, the numeral 15 designates generally a rifle which includes a frame or receiver 16, a stock (not shown) which is secured to the receiver, and a barrel 17. The gun is powered by pressurized air which is supplied by a hand pump assembly 18. The details of the receiver and other parts of the gun which are not specifically described herein are conventional and well known.

With the exception of the baffle and bleed-off port, the gun is substantially the same as the air gun which is described in U.S. Pat. No. 4,304,213. A hand grip 19 is pivotally secured to a pin 20, and a link 21 is pivotally secured to the hand grip and to a piston 22. A gasket is carried by the piston and sealingly engages the wall of a pumping tube 23 which is mounted on the receiver.

A valve assembly 25 (see also FIGS. 2–4) is mounted in the receiver for storing pressurized air until the gun is fired. The valve assembly includes a valve body 26 which is mounted within the pumping tube 23 and which is provided with a pressure reservoir or chamber 27. The forward end of the valve body faces the piston 22 and is provided with an air inlet 28. The inlet is normally closed by a check valve 29 which is resiliently biased against a conical seat within the valve body by a spring 30. An 0-ring 31 provides an air seal between the inlet end of the valve body and the pumping tube 23.

Figure 5:
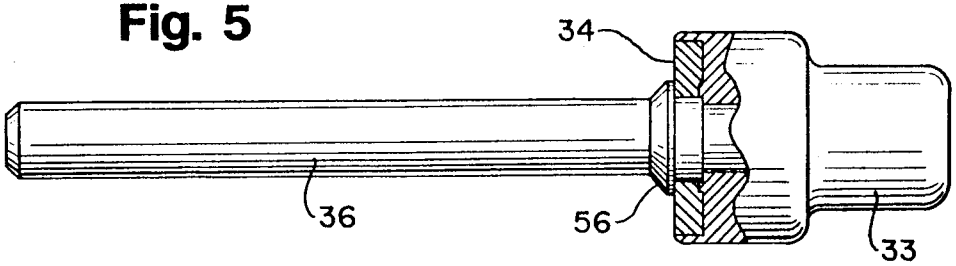
FIG. 5 is a side view partially broken away, of the valve.

The rear end of the pressure reservoir port 32 is normally closed by a valve 33 which is also resiliently biased by the spring 30. The valve 33 includes a resilient sealing ring 34 (FIG. 5) which engages a valve seat 35 (FIG. 6) on the valve body and a valve stem 36 which extends through an air passage 37 in the valve body for engagement by the firing mechanism of the gun.

The pressure reservoir within the valve body 26 is pressurized with air by pivoting the hand grip 19. Each time the piston 22 is moved toward the valve body, air is compressed by the piston and forced past the check valve 29 into the pressure reservoir. The pressure within the reservoir is thereby increased each time the hand grip is pumped.

As described in U.S. Pat. No. 4,304,213, a projectile such as a BB is loaded into the breech end of the barrel 17 by a bolt. The bolt positions the BB just forwardly of a port in the barrel which communicates with an exhaust port 38 which extends upwardly from the air passage 37.

The firing mechanism includes a hammer 40 which is slidably mounted in the rear end of the pumping tube 23. The hammer is resiliently biased to the right by a hammer spring 41. The hammer may be retracted to the left to a firing position by a lever on the bolt assembly. The hammer is maintained in the firing position by a sear 42. The sear is pivotable by a trigger 43 for releasing the hammer, and the hammer spring drives the hammer toward the valve stem 36. When the valve 33 is moved to the right, the valve seal 34 is removed from the valve seat 35, and pressurized air flows from the reservoir through the exhaust port 38 to propel the BB.

Figure 6:
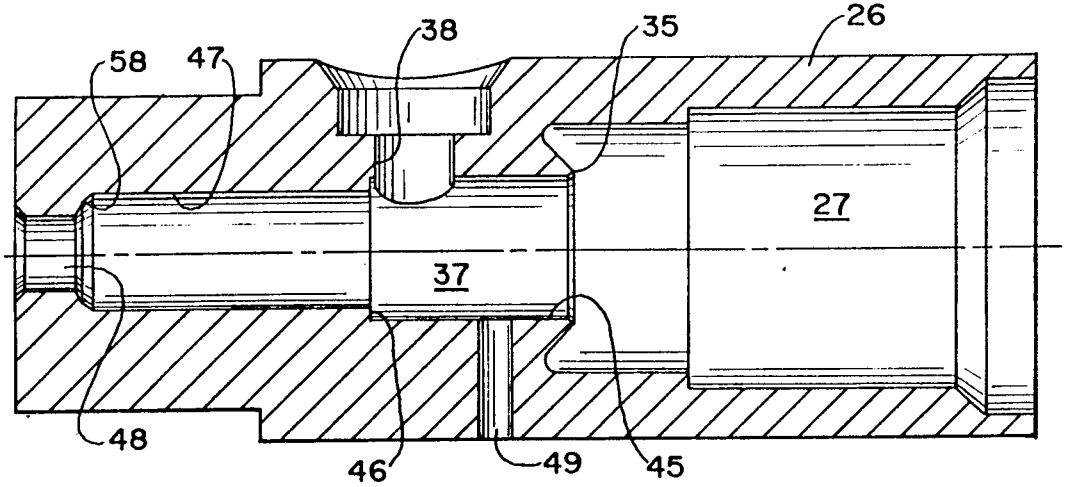
FIG. 6 is a sectional view of the valve body.

Referring to FIG. 6, the air passage 37 is provided by a cylindrical wall 45 which terminates at a radially inwardly extending shoulder 46. The valve stem 36 extends rearwardly within a second cylindrical wall 47 and through a rear opening 48 in the valve body. The rear opening 48 is just slightly larger than the valve stem to minimize pressure loss. The exhaust port 38 extends through the cylindrical wall 45 just forwardly of the shoulder 46, and a bleed-off hole 49 extends through the cylindrical wall forwardly of the exhaust port.

Figure 7:
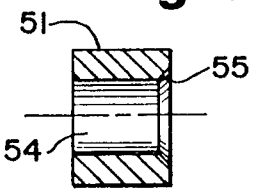
FIG. 7 is a sectional view of the baffle.
Figure 8:
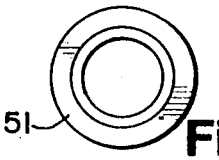
FIG. 8 is an end view of the baffle.
Figure 9:
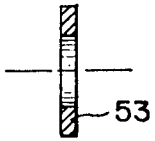
FIG. 9 is a sectional view of the washer for the baffle.
Figure 10:
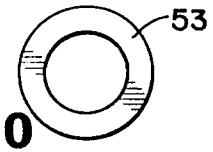
FIG. 10 is an end view of the washer.

A cylindrical baffle 51 (FIGS. 7 and 8) is ensleeved over the valve stem 36 (FIGS. 2–4) and is resiliently biased toward the valve seal 34 by a coil spring 52. The baffle is preferably formed of plastic, and an annular steel washer 53 (FIGS. 9 and 10) is positioned between the baffle spring and the baffle. The washer protects the rear end of the baffle when the baffle and washer are forced rearwardly against the shoulder 46 as shown in FIG. 4.

The outside diameter of the baffle 51 is less than the diameter of the cylindrical wall 45 of the air passage 37 so that pressurized air can flow between the baffle and the wall 45 when the gun is fired. The baffle has a central opening 54 which is just slightly larger than the diameter of the valve stem 36 so that the baffle can slide freely on the valve stem, but air flow between the baffle and the valve stem is restricted. The forward end of the opening 54 terminates in a flared wall 55 which engages a flared wall 56 (FIG. 5) on the valve stem which retains the valve seal 34.

The axial length of the baffle 51 is such that when the valve is closed, the baffle extends over the bleed-off hole 49 as shown in FIG. 1, but the exhaust port 38 is substantially unobstructed. When the baffle is in its rearward position in which the washer 53 engages the shoulder 46 (FIG. 4), the bleed-off hole 49 is substantially unobstructed by the baffle.

FIG. 1 illustrates the valve assembly before the gun is fired. The valve seal 34 engages the valve seat 35 of the valve body, and pressurized air is retained within the pressure reservoir 27. The baffle 51 is maintained against the flared wall 56 on the valve stem by the baffle spring 52. The rear end of the baffle spring engages a shoulder 58 (FIG. 6) between the wall 47 and the opening 48.

Figure 2:
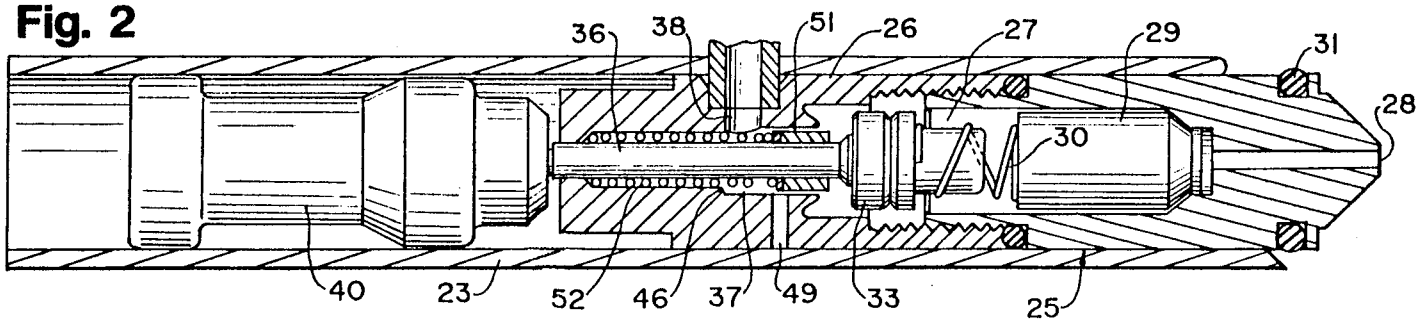
FIG. 2 is an enlarged fragmentary sectional view of the valve assembly during discharge when the valve reservoir contains low air pressure.

FIG. 2 illustrates the valve assembly when the gun is fired when the pressure in the pressure reservoir is relatively low. The hammer 40 impacts the valve stem 36 and moves the valve seal 34 away from the valve seat 35. Compressed air flows from the pressure reservoir between the baffle 51 and the cylindrical wall 45 of the valve body to the exhaust port 38. The compressed air impacts the baffle 51 and causes the baffle to slide rearwardly on the valve stem against the baffle spring 52, thereby partially shrouding the bleed-off hole 49 and permitting the majority of the air charge to flow through the exhaust port 38 to the projectile. The presence of the bleed-off hole causes minor performance reduction at low pressure because some of the air charge flows through the bleed-off hole to the outside of the valve body. However, the air loss is minimized by the shrouding effect of the baffle 51 on the bleed-off hole.

Figure 3:
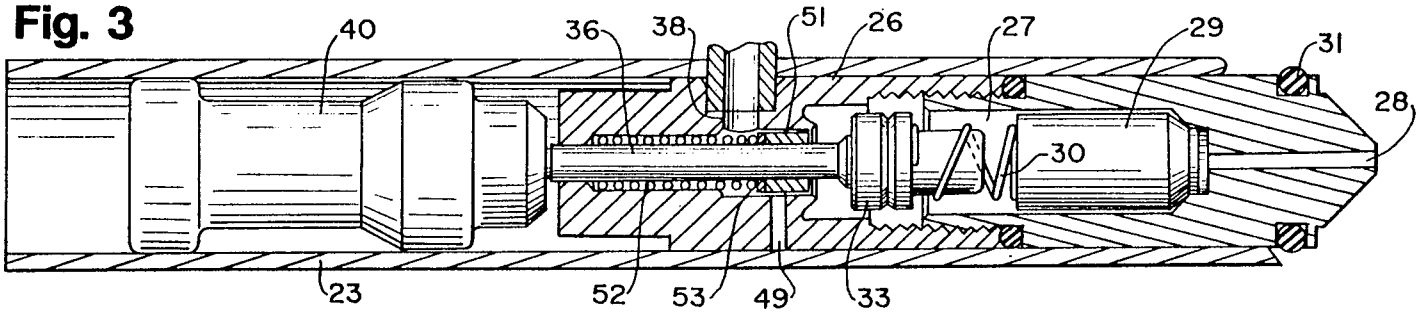
FIG. 3 is a view similar to FIG. 2 when the valve reservoir contains medium pressure.
Figure 4:
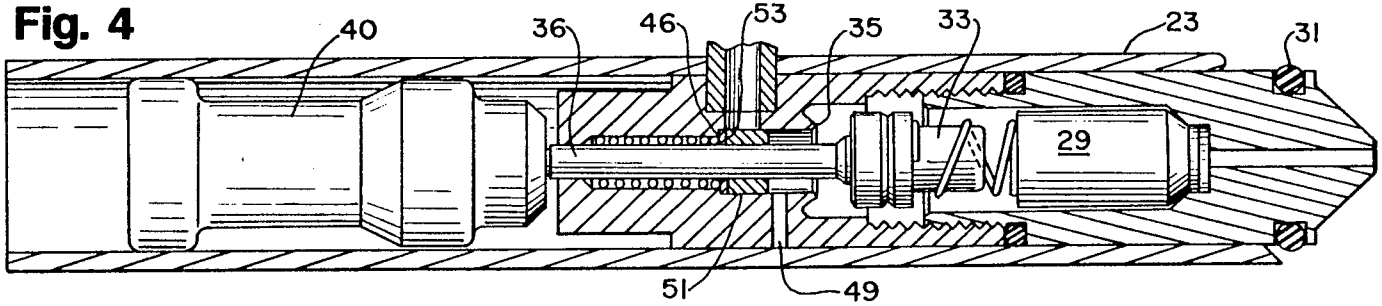
FIG. 4 is a view similar to FIGS. 2 and 3 when the valve reservoir contains high pressure.

FIG. 3 illustrates the valve assembly when the pressure reservoir contains a medium pressure air charge. Rearward travel of the baffle 51 is incresed due to the greater air pressure impacting the baffle, but the bleed-off hole 49 remains partially shrouded by the baffle. Performance of the gun and velocity of the projectile increase over low pressure operation is substantially the same way as for a conventional gun.

FIG. 4 illustrates high pressure operation. The baffle 51 is impacted by the high pressure air charge and is forced fully rearwardly until the washer 53 engages the shoulder 46. The exhaust port 38 is shrouded by the baffle, and the bleed-off opening 49 is fully exposed. A portion of the air charge is exhausted through the bleed-off hole while the remainder of the air charge flows through the exhaust port 38 to the projectile. The baffle not only restricts air flow through the exhaust port, but it also breaks up the high pressure shock wave which would otherwise travel through the air passage 37 and prevents the shock wave from reaching the projectile.

As the pressure in the pressure reservoir is further increased, the travel time of the baffle to its rear position is reduced. The shrouding effect of the baffle on the exhaust port and the opening of the bleed-off hole thereby occur faster, and projectile velocity is reduced.

A typical air gun might develop about 150 psi of air pressure in the pressure reservoir for each stroke of the air pump. Ten pumps will develop about 1500 psi in the pressure reservoir. The exact amount depends on a number of factors such as length of stroke, valve volume, efficiency of the piston gasket, etc. One specific embodiment of a valve assembly formed in accordance with the invention developed maximum projectile velocity of about 500 feet per second. Maximum velocity occurred at about 10 to 12 pumps. Once maximum velocity was reached, additional pumping decreased velocity because the baffle response was so fast that the exhaust port was shrouded throughout the discharge time.

Table 1 compares projectile velocities of air guns which have comparable valve assemblies except that one valve assembly is conventional and does not have a baffle or a bleed-off hole (Unmodified Valve Assembly) and the other valve assembly includes the baffle and bleed-off hole (Modified Valve Assembly).

| No. of Pumps | Modified Valve Assembly |
|---|---|
| 3 | 277 fps |
| 6 | 384 fps |
| 10 | 457 fps |
| 15 | 454 fps |

Due to the bleed-off hole and the baffle, velocity values of the modified valve are approximately 75% of those of the unmodified valve until maximum velocity for the modified valve is reached. Thereafter velocity for the unmodified valve continues to increase, and the velocity for the modified valve decreases.

Maximum velocity of the valve assembly can be varied by varying the diameter of the bushing and the spring force of the baffle spring. A bigger bushing provides greater shrouding, and a lighter spring provides quicker baffle response to the air charge.

In one specific embodiment of the invention, the baffle 51 was 0.156 inch long, the outside diameter was 0.211±0.001 inch, the inside diameter was 0.128+0.002 and −0.000. The baffle was molded from Zytel 70633 plastic.

The baffle spring 52 was formed from music wire having a diameter of 0.021±0.001 inch. The length of the uncompressed spring was 0.876 inch. The spring rate was 4.6 pounds/inch. The length of the spring and the associated parts was such that the spring was compressed into the FIG. 1 condition to provide a pre-load of 1.2 pounds±10 percent of spring force against the baffle 51. The spring was compressed to a length of 0.615 inch in FIG. 1. When the spring was fully compressed to a length of 0.467 inch, it provided a spring force of 1.88 pounds ±10 percent.

The washer 53 was 0.020±0.001 inch thick and the outside and inside diameters were 0.0210±0.001 and 0.128+0.002 and −0.001 inch, respectively.

The diameter of the exhaust port 38 was 0.125+0.004 and −0.000 inch, and the rear portion of the exhaust port was tangent to the shoulder 46. The diameter of the bleed-off hole 49 was 0.055±0.001 inch, and the center of the bleed-off hole was 0.129 inch from the valve seat 35 and 0.203 inch from the shoulder 46. The diameter of the cylindrical wall 45 of the valve body was 0.234+0.001. The diameter of the valve stem 36 was 0.124+0.0000 and −0.0013.

In FIG. 1 the baffle and washer are forced fully to the shoulder on the valve stem, and the parts are pre-loaded with approximately 1.2 pounds of spring force. Upon firing, the impact of the air pressure charge on the baffle and washer causes force to be applied to the baffle. When enough force is applied to overcome the spring pre-load, the spring is compressed by the baffle and washer until the spring force, which increases as the spring is compressed, equals the force being created by the pressure on the baffle. At this point, baffle and washer travel stops, and as the pressure is exhausted, the baffle spring pushes the baffle and washer to their original position. Because of this, as the air pressure and resultant force on the baffle is increased, compression on the baffle spring is increased and the compression results in greater movement of the baffle and washer until the equilibrium point is reached. When the air pressure and resultant force becomes greater than the load exerted by the fully compressed spring, the baffle and washer travel is stopped by the washer impacting the shoulder 46 in the valve body.

While in the foregoing specification a detailed description of specific embodiments of the invention were set forth for the purpose of illustration, it will be understood that many of the details herein given may be varied considerably by those skilled in the art without departing from the spirit and scope of the invention.

I claim:

1. An air gun comprising:

a frame, a barrel mounted on the frame, a valve body on the frame having a forward portion which provides a pressure reservoir for storing pressurized air, a rear portion which is provided with an air passage, and a valve seat between the forward and rear portions, the rear portion of the valve body including a first opening which provides communication between the air passage and the exterior of the valve body and a second opening which provides communication between the air passage and the barrel, pump means for supplying pressurized air to the pressure reservoir, a valve movably mounted in the valve body for movement between a closed position in which the valve prevents pressurized air from leaving the pressure reservoir and an open position in which the valve permits pressurized air to flow from the pressure reservoir to the barrel for propelling a projectile out of the barrel, a baffle slidably mounted in the air passage of the valve body, the baffle being movable between a first position in which the baffle restricts the first opening in the valve body and the second opening is substantially unobstructed and a second position in which the baffle restricts the second opening in the valve body and the first opening is substantially unobstructed, a spring resiliently biasing the baffle toward the valve seat, and firing means for moving the valve from the closed position to the open position.

2. The air gun of claim 1 in which the valve includes a valve seal which engages the valve seat when the valve is in the closed position and a valve stem which extends through said air passage of the valve body.

3. The air gun of claim 2 in which the baffle is cylindrical and is ensleeved over the valve stem.

4. The air gun of claim 3 in which the spring is a compression spring which is ensleeved over the valve stem.

5. The air gun of claim 4 including an annular washer ensleeved on the valve stem between the spring and the baffle.

6. The air gun of claim 1 in which the first opening in the valve body is forward of the second opening.

7. The air gun of claim 1 in which the air passage includes a cylindrical wall and the baffle is cylindrical, the outside diameter of the baffle being less than the inside diameter of the wall of the air passage so that pressurized air from the pressure reservoir can flow between the baffle and the wall of the air passage when the valve is open.

8. The air gun of claim 7 in which the valve includes a valve seal which engages the valve seat when the valve is in the closed position and a valve stem which extends through said air passage of the valve body, the baffle being ensleeved over the valve stem.

9. The air gun of claim 8 in which the spring is a coil spring which is ensleeved over the valve stem.

10. The air gun of claim 9 including an annular washer ensleeved on the valve stem between the spring and the baffle.

11. The air gun of claim 7 in which the rear end of the cylindrical wall terminates in a radially inwardly extending shoulder which provides a stop for the baffle when the baffle is in its second position, the length of the baffle being greater than the distance between the shoulder and the second opening in the valve body and less than the maximum distance between the shoulder and the first opening in the valve body.

12. The air gun of claim 11 in which the length of the baffle is greater than the distance between the valve seat and the first opening in the valve body.

13. The air gun of claim 11 in which the baffle comprises a cylindrical plastic sleeve.

14. The air gun of claim 7 in which the diameter of the baffle is about 0.023 inch less than the diameter of the cylindrical wall.

15. The air gun of claim 7 in which the diameter of the baffle is within the range of 0.020 to 0.030 inch less than the diameter of the cylindrical wall.

16. The air gun of claim 7 in which the length of the baffle is greater than the distance between the valve seat and the first opening in the valve body.

* * * * *